US012492873B1

(12) United States Patent
Bray

(10) Patent No.: US 12,492,873 B1
(45) Date of Patent: Dec. 9, 2025

(54) DELAYED BLOWBACK SYSTEM FOR A FIREARM

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 18/948,069

(22) Filed: Nov. 14, 2024

(51) Int. Cl.
*F41A 3/26* (2006.01)
*F41A 3/38* (2006.01)
*F41A 3/66* (2006.01)

(52) U.S. Cl.
CPC *F41A 3/26* (2013.01); *F41A 3/38* (2013.01); *F41A 3/66* (2013.01)

(58) Field of Classification Search
CPC ..... F41A 3/38; F41A 3/66; F41A 3/26; F41A 5/18; F41A 19/44; F41A 19/13; F41A 21/28; F41A 21/48; F41A 3/72; F41C 23/16
USPC ..... 89/190, 185, 192, 33.2, 1.801; 124/56, 124/74; 42/1.04, 70.08, 71.01, 75.02
See application file for complete search history.

(56) References Cited

U.S. PATENT DOCUMENTS 3,314,183 A * 4/1967 Center ..... F41A 5/26 89/184
3,874,265 A * 4/1975 Kruzell ..... F41A 9/30 89/1.801
4,253,378 A * 3/1981 Donovan ..... F41A 3/42 89/142
4,270,437 A * 6/1981 Donovan ..... F41A 9/32 89/33.2
4,296,564 A * 10/1981 Oberst ..... F41A 9/53 42/1.04
5,651,205 A * 7/1997 Ruger ..... F41A 17/24 89/190
6,470,872 B1 * 10/2002 Tiberius ..... F41B 11/721 124/56
7,770,317 B1 * 8/2010 Tankersley ..... F41C 23/16 42/71.01
9,638,481 B1 * 5/2017 Marano ..... F41A 3/72
11,112,192 B2 * 9/2021 Herring ..... F41A 17/40
11,187,473 B1 * 11/2021 Richey ..... F41A 17/16
11,313,633 B1 * 4/2022 Richey ..... F41A 15/14
11,499,796 B2 * 11/2022 Martini ..... F41A 21/34
2012/0180354 A1 * 7/2012 Sullivan ..... F41A 21/48 42/16
2014/0196267 A1 * 7/2014 Tiberius ..... F41A 33/02 29/401.1
2020/0232734 A1 * 7/2020 Herring ..... F41A 9/37
2020/0256636 A1 * 8/2020 Martini ..... F41A 35/02
2022/0325966 A1 * 10/2022 Richey ..... F41A 15/14

* cited by examiner

*Primary Examiner* — Michael D David
(74) *Attorney, Agent, or Firm* — Kunzler Bean & Adamson

(57) ABSTRACT

Apparatuses, systems, and methods are disclosed for delayed blowback mechanisms for use in or with firearms. The delayed blowback mechanism includes a housing having an internal chamber, where the housing comprises a cam pathway. The delayed blowback mechanism also includes a pivoting latch disposed at least partially within the internal chamber, where the pivoting latch is movable, with respect to the housing, along the cam pathway between a first position and a second position.

20 Claims, 10 Drawing Sheets

DELAYED BLOWBACK SYSTEM FOR A FIREARM

FIELD

This disclosure relates generally to firearms, and more particularly to delayed bolt action blowback assemblies.

BACKGROUND

Components that are common to most firearm designs include a barrel, a receiver, and a trigger. Activation of the trigger causes a firing pin to strike a firearm round which ignites a propellant that creates gases that send a projectile through the barrel. A portion of the gasses also act on a bolt assembly or a slide, via various different mechanisms, to eject the firearm round and load a new round. This is known as "blowback."

Generally, in a simple blowback system, the bolt assembly engages the rear of the barrel (i.e., the breech), but is not locked to the barrel. When fired, the gases push the projectile through the barrel while also pushing a cartridge of the firearm round against the bolt assembly in the opposite direction. This cycling of the bolt assembly ejects the spent cartridge and pushes a new cartridge from the magazine forward into the chamber.

Cycling of the bolt assembly in simple blowback systems is known to have several problems, including muzzle climb and attenuating recoil. Delayed blowback system have been found to be advantageous because they reduce recoil by slowing down the rearward movement of the bolt assembly, and they enhance durability by allowing chamber pressure to drop before extraction of the spent cartridge. Delayed blowback systems also improve accuracy due to the reduced recoil, and increase compatibility with higher-powered rounds and their associated higher pressures and energies.

There are various types of delayed blowback systems that can be generally described as either: (a) inertia delayed blowback due to the weight of the bolt assembly; (b) gas-delayed blowback; or (c) a braking system. However, each of these delayed blowback systems has problems whether that is a heavy reciprocating mass, heavy rate recoil springs, or a system that is not operable with lighter weight ammunition, etc.

SUMMARY

Apparatuses are disclosed for use in firearms. In certain examples, the apparatus includes a delayed blowback mechanism configured to delay the opening of a bolt carrier assembly following the firing of a firearm round. The delayed blowback mechanism includes a housing having an internal chamber, where the housing comprises a cam pathway. The delayed blowback mechanism also includes a latch disposed at least partially within the internal chamber, where the latch is movable, with respect to the housing, along the cam pathway between a first position and a second position.

In certain examples, the pivoting latch is configured to couple with a bolt carrier assembly of a firearm when in the first position. The latch further comprises a downwardly extending finger configured to engage a feature of the bolt carrier assembly. In certain examples, the latch is configured to release the bolt carrier assembly during a transition from the first position to the second position.

The delayed blowback mechanism, in certain examples, includes a pair of cutouts formed in sidewalls of the housing, and where the pair of cutouts form the cam pathway. The latch may include a pass-through opening configured to receive a pin, and the pass-though opening is configured to align with the pair of cutouts. The pin has a length greater than a width of the latch, and the pin is configured to engage surfaces of the pair of cutouts. In certain examples, the pin is configured to follow the cam pathway and rotate the latch with respect to the housing as the latch moves from the first position to the second position.

In certain examples, the delayed blowback mechanism includes a guide rod pivotally coupled to the latch and configured to pass through an opening in the housing. A spring may be coupled to the guide rod and disposed adjacent to the housing, where the spring is configured to bias the latch towards the first position.

Various firearms are also disclosed that implement the delayed blowback mechanism. A method for delayed blowback of a bolt carrier assembly is also disclosed. The method includes providing a housing having an internal chamber, where the housing comprises a cam pathway. The method also includes providing a pivoting latch disposed at least partially within the internal chamber, where the pivoting latch is movable, with respect to the housing, along the cam pathway between a first position and a second position.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
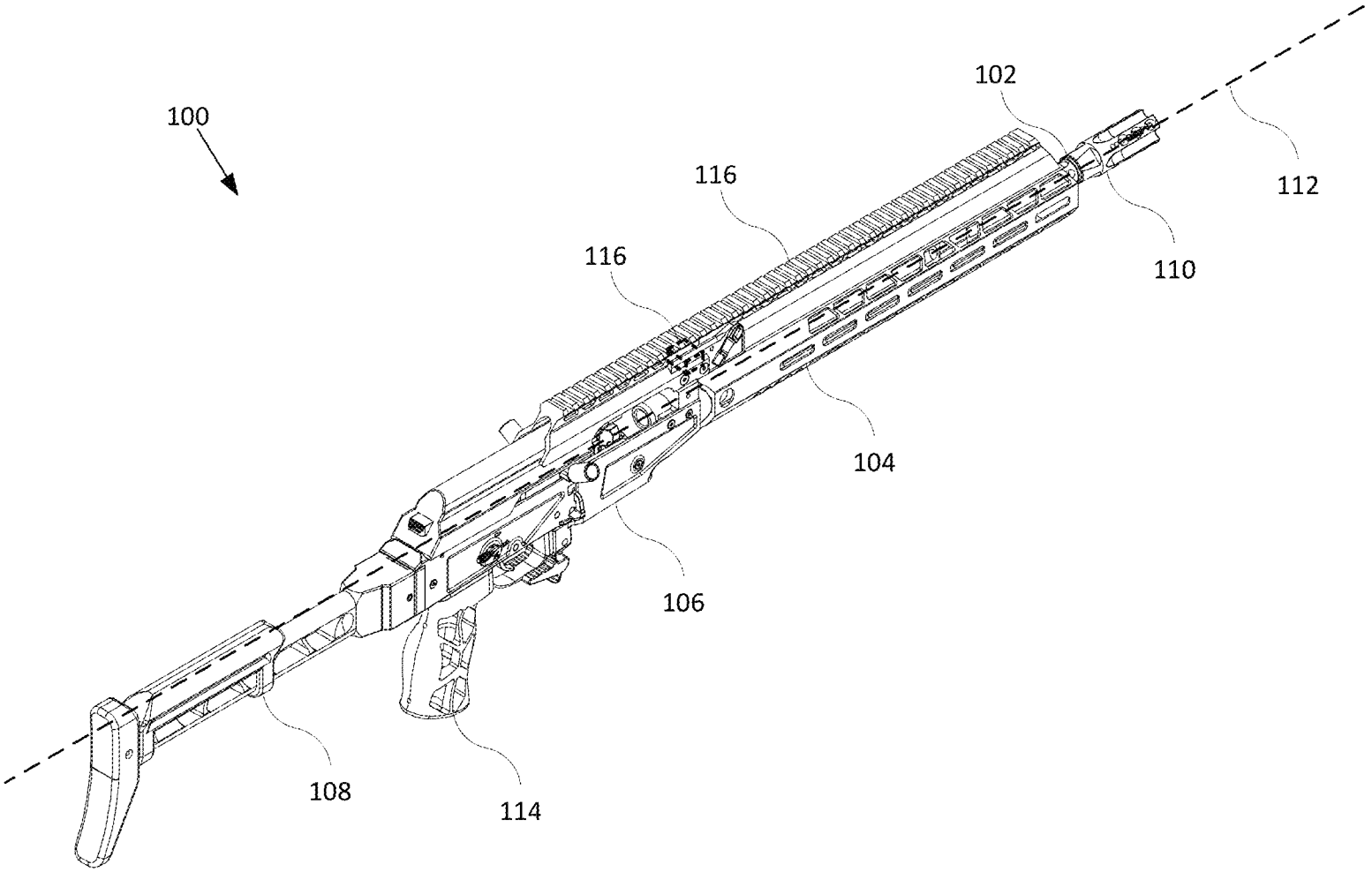
FIG. 1 is a perspective view diagram illustrating one example of a firearm, in accordance with examples of the subject disclosure.

FIG. 1 is a perspective view diagram illustrating one example of a firearm 100, in accordance with examples of the subject disclosure. Although an AK-style firearm is depicted, the features and benefits of the examples of this disclosure are applicable to any centerfire and/or rimfire firearm, including but not limited to AR-style firearms, and 10/22 firearms, as will be described below in greater detail.

The firearm 100, in certain examples, may include a barrel 102, a handguard 104 that surrounds a portion of the barrel 102, a receiver 106, and a stock 108. Various other components of the firearm 100 are depicted which will be described in further detail below. As used herein, the terms "forward" and "front" refer to ends of mechanisms or devices that are nearest the muzzle end 110 of the firearm 100. Similarly, "rear" or "rearward" corresponds to ends of mechanisms or devices that are furthest from the muzzle end 110 of the firearm 100 (i.e., towards the stock 108). Terms such as "top" and "bottom" may also be used and refer to component positions as if the firearm were held in a traditional orientation, for example with the accessory rail 116 located on "top" of or "above" the receiver 106 and the handguard 104. A hand grip 114 is disposed to the rear and below the receiver 106. Also depicted is a bore axis 112 that is defined by the barrel 102.

A delayed blowback mechanism 118 is disposed within the receiver 106 and is configured to delay the bolt carrier assembly (see FIG. 2) from opening after the firing of the firearm 100. Beneficially, a delayed blowback mechanism 118 according to the examples of the subject disclosure allow for cleaner operation of the firearm because delaying the opening of the bolt carrier assembly causes exhaust gasses to travel forward and out of the barrel. Another benefit of the delayed blowback mechanism 118 is to allow the use of a lighter bolt carrier assembly, and lighter recoil springs.

Figure 2:
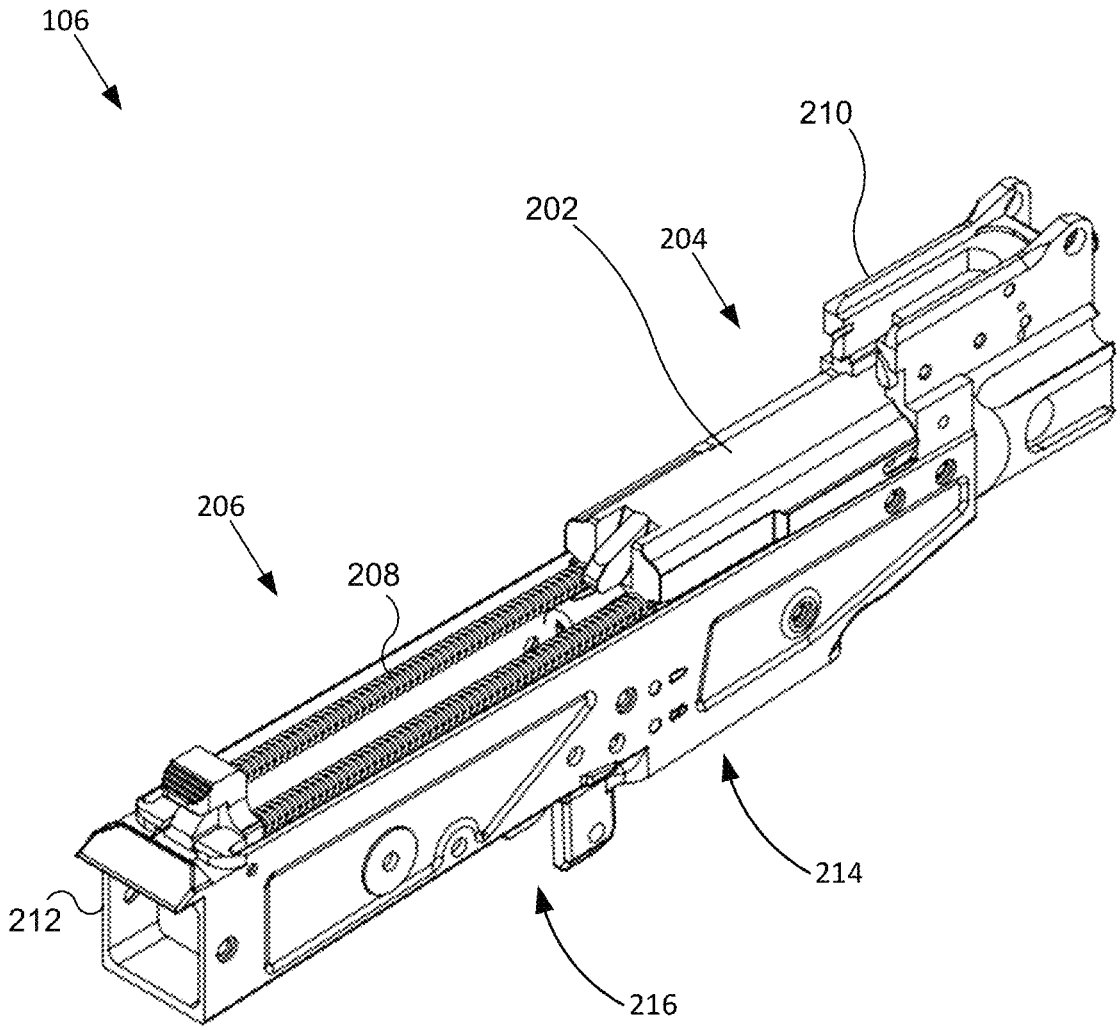
FIG. 2 is a perspective view diagram illustrating one example of the receiver, in accordance with examples of the subject disclosure.

FIG. 2 is a perspective view diagram illustrating one example of the receiver 106, in accordance with examples of the subject disclosure. The receiver 106 may be formed from a machined block of lightweight aluminum or other lightweight metal alloys that are capable of withstanding the forces and temperatures that are generated from firing the firearm 100.

In certain examples, a bolt carrier assembly 202 is disposed at least partially within the receiver 106 and movable between a first position 204 and a second position 206. A gas block (not shown here) allows gases in the barrel 102 from firing a cartridge to expand into a gas tube above the barrel 102, pushing a gas piston backward in the tube. The gas piston pushes the bolt carrier assembly 202 back towards the second position 206 to extract a spent case. In other examples, which are described below in greater detail with reference to FIGS. 7A-8. Recoil springs 208 bias the bolt carrier assembly towards the first position 204 to chamber the next round. Forces from firing the cartridge also act on the bolt carrier assembly 202 and cause it to move towards the second position 206.

In some AK-47 type rifles, blocks of metal may be attached to the front and rear of the receiver 106 to attach and support the barrel 102 and the stock 108. Such blocks may be referred to, respectively, as front and rear trunnions. The front trunnion may also be referred to as a firearm barrel trunnion. When the term "trunnion" is used herein without a modifier such as "front" or "rear," it refers to the firearm barrel trunnion, not to the rear trunnion. FIG. 2 depicts an example of an AK-47 style rifle that includes a front trunnion 210 and a rear trunnion 212. However, it is contemplated that the features and benefits of the delayed blowback mechanism of the present disclosure are adaptable to firearms that do not include a trunnion. In certain examples, the delayed blowback mechanism 118 (not visible here) is disposed within the front trunnion 210 and positioned such that the delayed blowback mechanism 118 engages with and latches onto a front portion of the bolt carrier assembly 202.

In certain examples, the receiver 106 is configured to attach to the front trunnion 210 or the rear trunnion 212 via screws, bolts, pins, or other fasteners. In other examples, the rear trunnion 212 may be coupled to the receiver 106 via a quick release mechanism. In yet other examples, the rear trunnion 212 is integrally formed with the receiver 106.

In certain examples the receiver 106 includes a magazine well 214. The magazine well 214 is an area of the receiver 106 adapted for receiving a magazine that holds ammunition. In certain examples, the receiver 106 also includes an opening 216 in the receiver to allow a trigger to pass from an interior area of the receiver 106 to an exterior area of the receiver 106.

Figure 3:
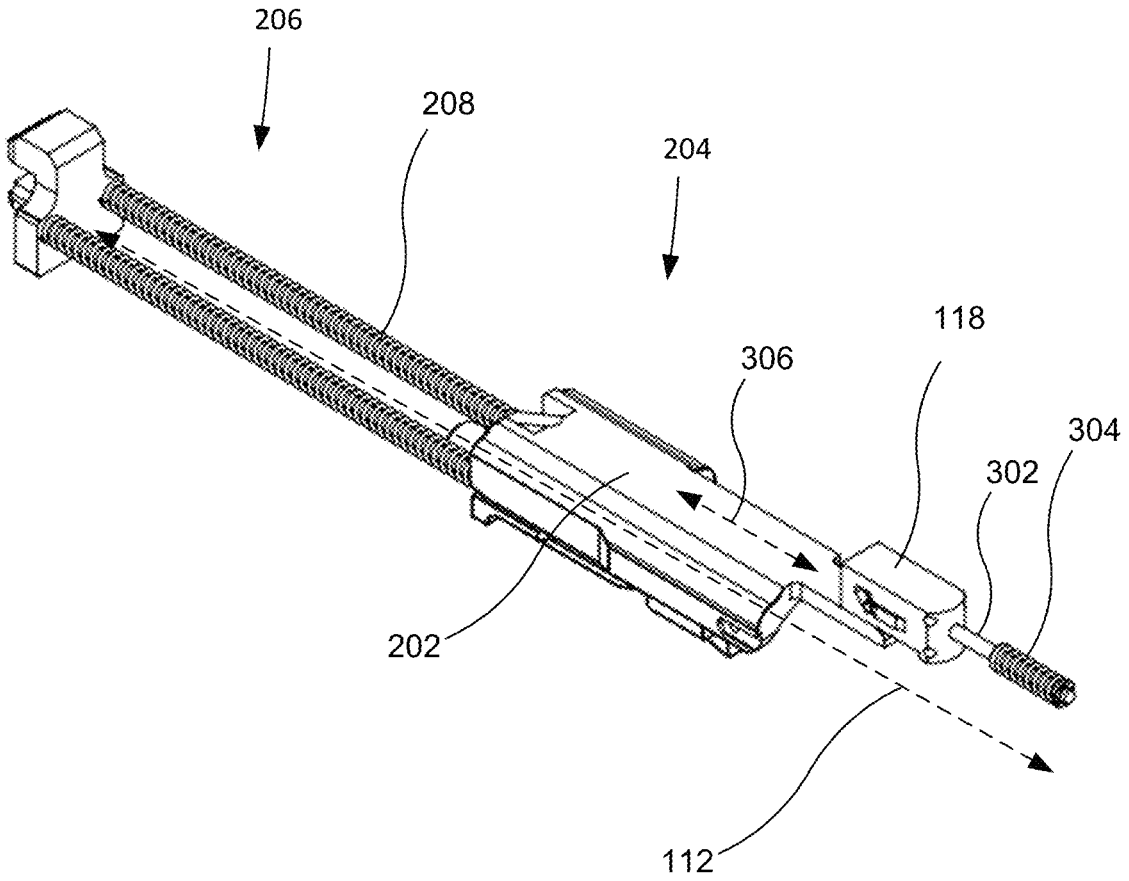
FIG. 3 is a perspective view diagram illustrating one example of the delayed blowback mechanism connecting with the bolt carrier assembly, in accordance with examples of the subject disclosure.

FIG. 3 is a perspective view diagram illustrating one example of the delayed blowback mechanism 118 connecting with the bolt carrier assembly 202, in accordance with examples of the subject disclosure. As described above with reference to FIG. 2, the bolt carrier assembly 202 is movable between the first position 204 and the second position 206 along guide rods that are disposed within the recoil springs 208. In other examples, the bolt carrier assembly 202 moves along a grooves or guides/channels that are formed in or coupled to the receiver 106. The bolt carrier assembly 202 moves along a path 306 that is substantially parallel with the bore axis 112, and bolt carrier assembly 202 cycles between the first position 204 (or forward position) and the second position 206 (or rearward position).

The delayed blowback mechanism 118 is configured to latch onto the bolt carrier assembly 202 when the bolt carrier assembly 202 is in the first position 204 (also known as the battery position). The delayed blowback mechanism 118 is configured to maintain the bolt carrier assembly 202 in the first position 204 for a duration of time after a firearm cartridge is fired. This beneficially allows for exhaust gasses to escape forward through the barrel 102 instead of rearward into the receiver 106. Other additional benefits include the ability to use a lower weight bolt carrier assembly 202 and lighter weight recoil springs 208, which results in a higher cyclic rate.

In certain examples, the delayed blowback mechanism 118 includes a guide rod 302 and a blowback spring 304. Components (see FIGS. 4A-4C) of the delayed blowback mechanism 118 are movable forward and rearward along an axis 306 that is substantially parallel with the bore axis 112. In its home or default position, the delayed blowback mechanism 118 is configured with a latch (see FIG. 4B) that engages the bolt carrier assembly 202 and retains the bolt carrier assembly 202 in the first position 204 for a predetermined amount of time. This predetermined amount of time is selectable according to the spring rate of the blowback spring 304. A higher spring rate or spring force results in a longer predetermined amount of time because of the amount of force required to overcome the blowback spring 304. A lower spring rate or spring force results in a lower predetermined amount of time.

Figure 4A:
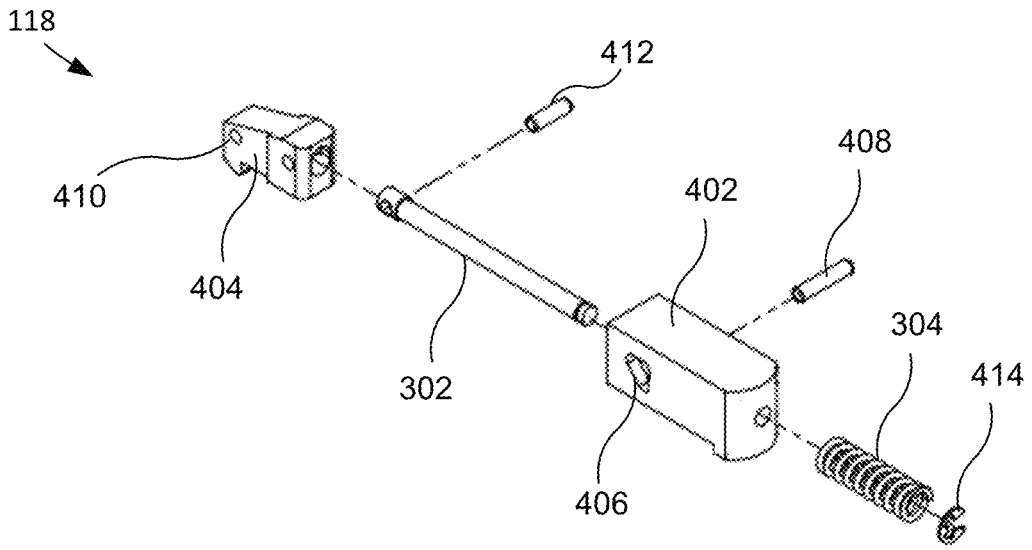
FIG. 4A is a perspective exploded view diagram of the delayed blowback mechanism, in accordance with examples of the subject disclosure.

FIG. 4A is a perspective exploded view diagram of the delayed blowback mechanism 118, in accordance with examples of the subject disclosure. In the depicted example, the delayed blowback mechanism 118 includes a housing 402, a pivoting latch 404, the guide rod 302, the blowback spring 304, and various pins. The housing 402, in certain examples, is configured with an internal chamber for sliding engagement with the pivoting latch 404. Stated differently, the pivoting latch 404 is disposed within the housing 402 and configured to slide forward and backward, with respect to the firearm 100, from a first position that latches the bolt carrier assembly 202 to a second position that is not in latching contact with the bolt carrier assembly 202.

The housing 402, in certain examples, includes a pair of ramps 406 formed in sidewalls of the housing 402. The ramps 406, in certain examples, are openings with a ramp surface that defines a plane that is transverse with respect to an axis defined by the path 306. In other words, an object that is in sliding contact with the ramps 406 will travel along a path that is not parallel with the path 306. Stated differently, cutouts that are formed in opposing sidewalls of the housing 402 may together form a cam pathway that define a pathway for a pin 408 to follow, as is described below in greater detail.

In the depicted example, the ramp pin 408, having a length sufficient to make contact with ramps 406 on both sides of the housing 402, is in sliding engagement with the ramps 406. In other words, the ramp pin 408 has a length that is greater than a width of the pivoting latch 404 so that the ramp pin 408 is enabled to contact the cam pathway on both sides of the housing 402. The ramp pin 408 is configured to pass through an opening 410 in the pivoting latch 404. As the pivoting latch 404 moves back and forth with respect to the housing 402, the ramp pin 408 rides up and down on the ramp 406 surface and in turn pivots the pivoting latch 404 upward and downward with respect to the housing 402 (see arrow 418 of FIG. 4B).

In certain examples, the pivoting latch 404 is pivotally connected with the guide rod 302 via a coupling pin 412. Beneficially, this pivotable coupling enables the pivoting latch 404 to rotate about the coupling pin 412 with respect to the guide rod 302. Also depicted is a circlip 414 that is configured to couple to an end of the guide rod 302 and maintain the blowback spring 304 on the guide rod 302.

Figure 4B:
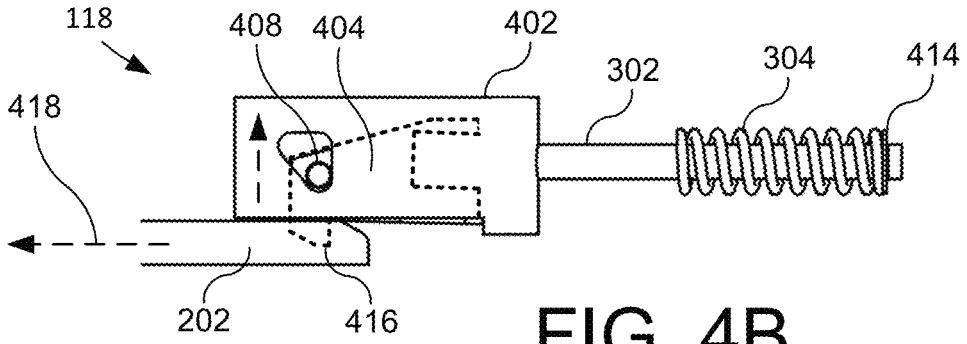
FIG. 4B is a side view diagram of the delayed blowback mechanism in latching engagement with the bolt carrier assembly, in accordance with examples of the subject disclosure.

FIG. 4B is a side view diagram of the delayed blowback mechanism 118 in latching engagement with the bolt carrier assembly 202, in accordance with examples of the subject disclosure. In the depicted example, the pivoting latch 404 has a downwardly extending finger 416 that is configured to engage an opening in the end of the bolt carrier assembly 202. Alternatively, the finger 416 may engage any other suitable feature of the bolt carrier assembly 202, including but not limited to, a ramp with a vertical catch surface.

As described above with reference to FIG. 4A, the ramp pin 408 is configured to be in sliding engagement with the ramp 406 surface that is formed in the housing 402. As a firearm cartridge is fired, the explosion of the gun powder propelling a projectile forward results in a rearward force on the bolt carrier assembly 202, as indicated by the arrow 418. The force, once the blowback spring 304 is overcome, causes the pivoting latch 404 to move rearward with respect to the housing 402. This rearward movement causes the pin 408 to ride up the ramps 406 and subsequently lift the pivoting latch 404 out of engagement with the bolt carrier assembly 202. The bolt carrier assembly 202 then operates normally to remove the fired cartridge, and load a new cartridge, and return to the first position 204 (see FIG. 2) where the pivoting latch 404 reengages with the bolt carrier assembly 202.

Figure 4C:
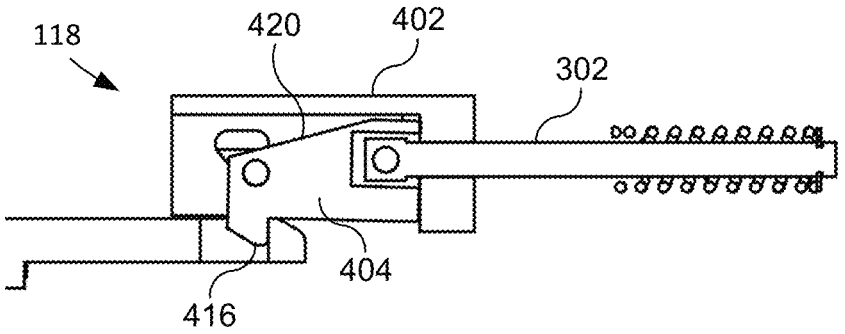
FIG. 4C is a side view of a cross-sectional diagram of the delayed blowback mechanism, in accordance with examples of the subject disclosure.

FIG. 4C is a side view of a cross-sectional diagram of the delayed blowback mechanism 118, in accordance with examples of the subject disclosure. The depicted example shows the chamber within the housing 402 for sliding engagement with the pivoting latch 404. The pivoting latch 404 has a generally rectangular shape with the downwardly extending finger 416 disposed at one end of the pivoting latch 404. The pivoting latch 404 is also configured with an upper surface 420 that slopes downward to enable the pivoting latch 404 to pivot upward within the housing 402. If the pivoting latch 404 were formed with a substantially rectangular shape, the pivoting latch 404 would not have the clearance to pivot upward.

Figure 5:
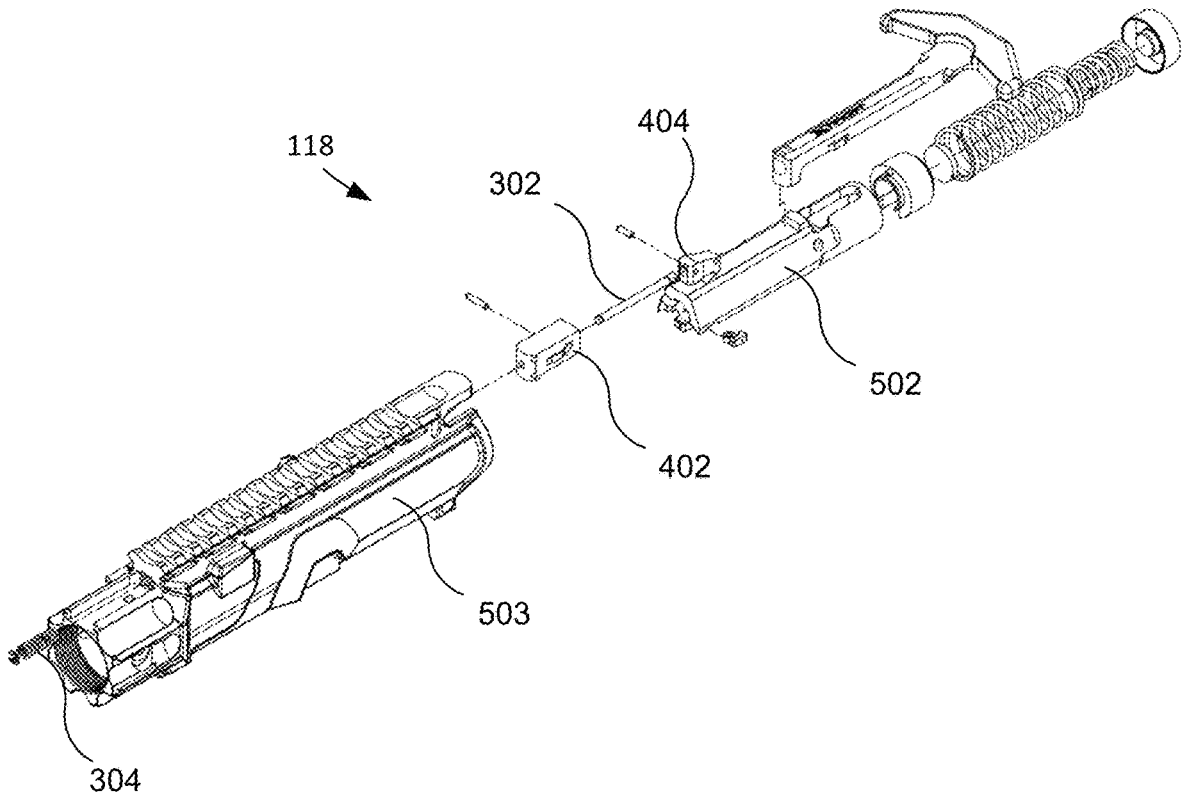
FIG. 5 is an exploded view diagram illustrating an example of the delayed blowback mechanism, in accordance with examples of the subject disclosure.

FIG. 5 is an exploded view diagram illustrating an example of the delayed blowback mechanism 118, in accordance with examples of the subject disclosure. In the depicted example, the delayed blowback mechanism 118 is configured for use with an AR-style firearm (e.g., AR-15, M16, M4, etc.). The delayed blowback mechanism 118, in this configuration, operates in a manner similar to that described above with reference to FIGS. 1-4C. The housing 402 is configured to be disposed within an upper receiver 503 and engage a bolt carrier assembly 502 of the AR-style firearm.

Figure 6A:
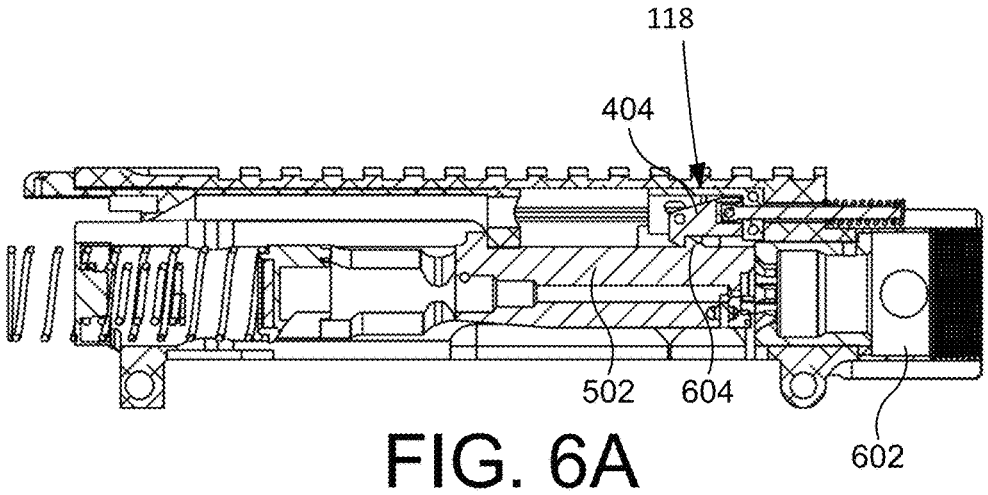
FIG. 6A is a side cross-sectional view diagram illustrating one example of positions of the pivoting latch with respect to the bolt carrier assembly, in accordance with examples of the subject disclosure.
Figure 6B:
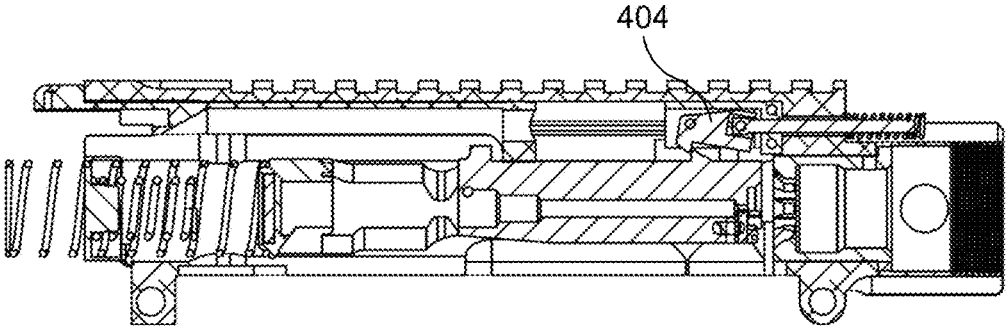
FIG. 6B is a side cross-sectional view diagram illustrating one example of positions of the pivoting latch with respect to the bolt carrier assembly, in accordance with examples of the subject disclosure.
Figure 6C:
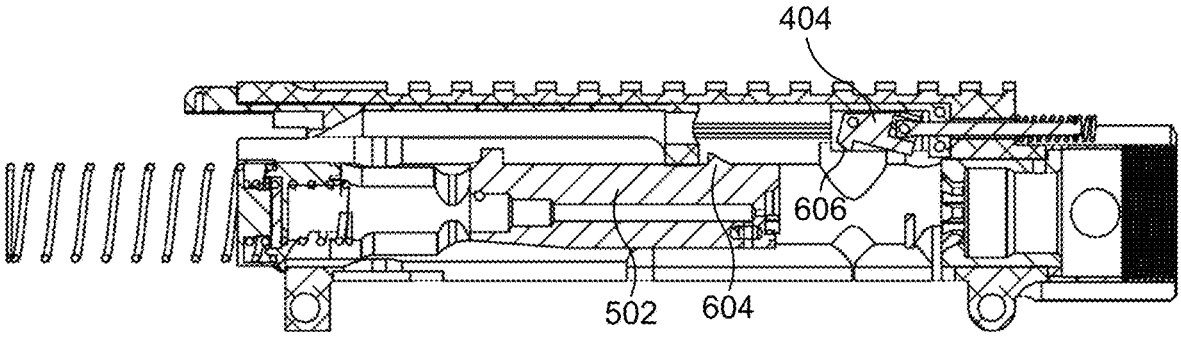
FIG. 6C is a side cross-sectional view diagram illustrating one example of positions of the pivoting latch with respect to the bolt carrier assembly, in accordance with examples of the subject disclosure.

FIGS. 6A-6C depict the positions of the pivoting latch 404 with respect to the bolt carrier assembly, in accordance with examples of the subject disclosure. In particular, these figures are cross-sectional diagrams that illustrate the delayed blowback mechanism 118 in use with an AR-style rife. However, the concepts and features discussed with reference to FIGS. 6A-6C are equally applicable to other firearms.

FIG. 6A depicts the pivoting latch 404 in a first position prior to a user pulling a trigger and firing the cartridge. In this illustration, the bolt carrier assembly 502 is in "battery" and the pivoting latch 404 is engaged with a feature 604 (opening or other catch) of the bolt carrier assembly. Upon firing the cartridge, the bolt carrier assembly 502 begins to move rearward away from the barrel 602 once the force is sufficient to overcome the blowback spring 304. The rearward movement of the pivoting latch 404 follows an upward pivoting trajectory due to the ramp 406 surfaces formed in the housing 402, and the pivoting latch 404 likewise begins to lift and disengage from the bolt carrier assembly 502. This scenario is depicted in FIG. 6B.

FIG. 6C depicts the pivoting latch 404 in the second position, or stated differently, in an upwardly pivoted position that is disconnected from the bolt carrier assembly 502. The duration of the pivoting latch 404 in the second position is brief because the blowback spring 304 is biased toward the first position. As such, the blowback spring 304 pushes on the circlip 414 and moves the pivoting latch 404 forward with respect to the housing 402, which lowers the pivoting latch 404 downward and returns to the first position. In certain examples, the downwardly extending finger 416 is configured with a sloped surface 606 to allow the feature 604 to pass under the pivoting latch 404 as the bolt carrier assembly 502 returns to the battery position.

Figure 7A:
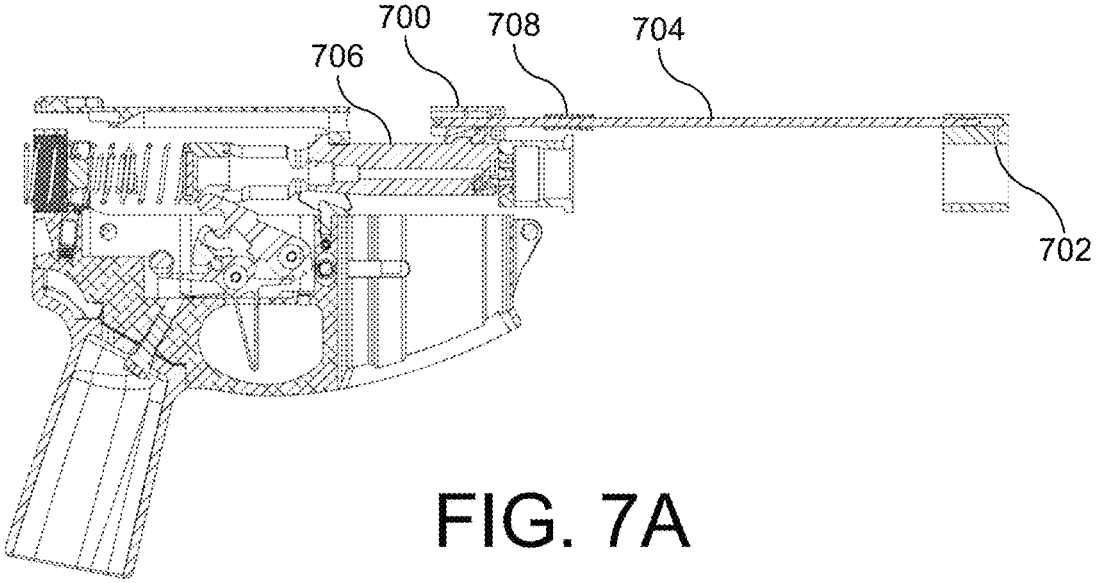
FIG. 7A is a side view of a cross-sectional diagram of a delayed blowback mechanism for a rimfire firearm, in accordance with examples of the subject disclosure.

FIG. 7A is a side view of a cross-sectional diagram of a delayed blowback mechanism 700 for a rimfire firearm, in accordance with examples of the subject disclosure. The delayed blowback mechanism 700 is configured to operate with a rimfire firearm, and may be actuated by exhaust gasses. A small amount of exhaust gasses are bled off from the barrel through a channel 702 to actuate an actuator rod 704 to move rearward and disconnect the locking block (see FIG. 7B) and allow the locking block to pivot upwards and release the bolt carrier assembly 706. A spring 708 biases the actuator rod 704 forward and holds the locking block in the locked position.

Figure 7B:
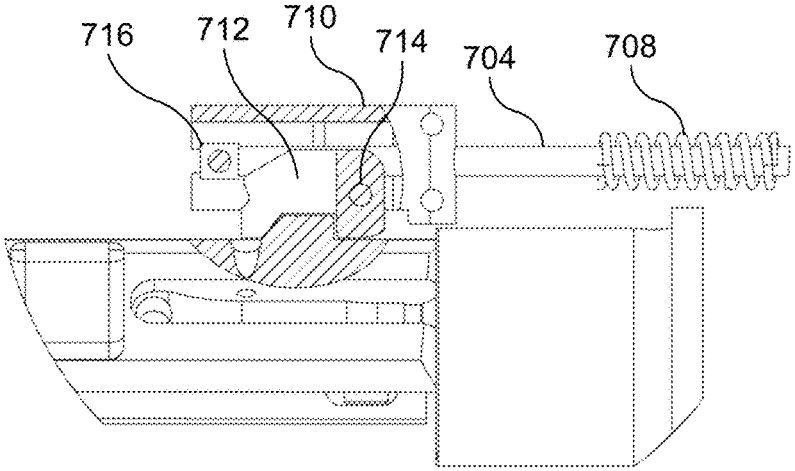
FIG. 7B is a side view cross-sectional diagram of the rimfire delayed blowback mechanism, in accordance with examples of the subject disclosure.
Figure 7C:
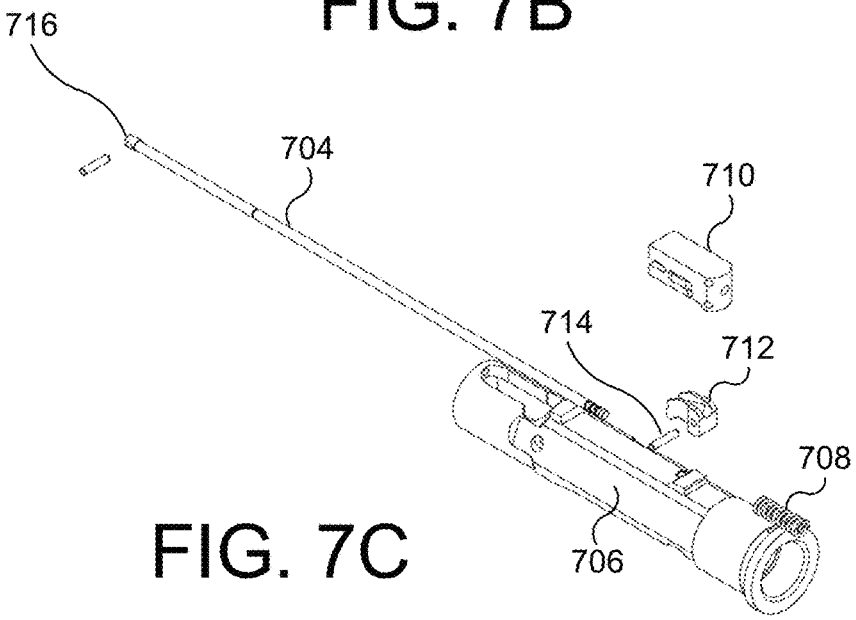
FIG. 7C is an exploded view diagram illustrating one example of the rimfire delayed blowback mechanism, in accordance with examples of the subject disclosure.

FIG. 7B is a side view cross-sectional diagram of the rimfire delayed blowback mechanism 700, in accordance with examples of the subject disclosure. FIG. 7C is an exploded view diagram illustrating one example of the rimfire delayed blowback mechanism 700, in accordance with examples of the subject disclosure. Referring now jointly to FIGS. 7B and 7C, in certain examples, the rimfire delayed blowback mechanism includes a housing 710 disposed above the bolt carrier assembly 706 when in battery position. The housing 710 is configured with an inner chamber for housing a locking block 712. The locking block 712 is pivotally connected to the housing by a pin 714. The locking block 712 is configured to pivot from a first locked position, as depicted in FIG. 7B, to a second unlocked position. In certain examples, the locking block 712 has a curved upper surface, or saddle, for sliding engagement with the actuator rod 704. An end 716 of the actuator rod 704 cycles back and forth in a path that is defined by linear openings in the sides of the housing 710, as will be discussed in greater detail below, with reference to FIG. 8.

Figure 8:
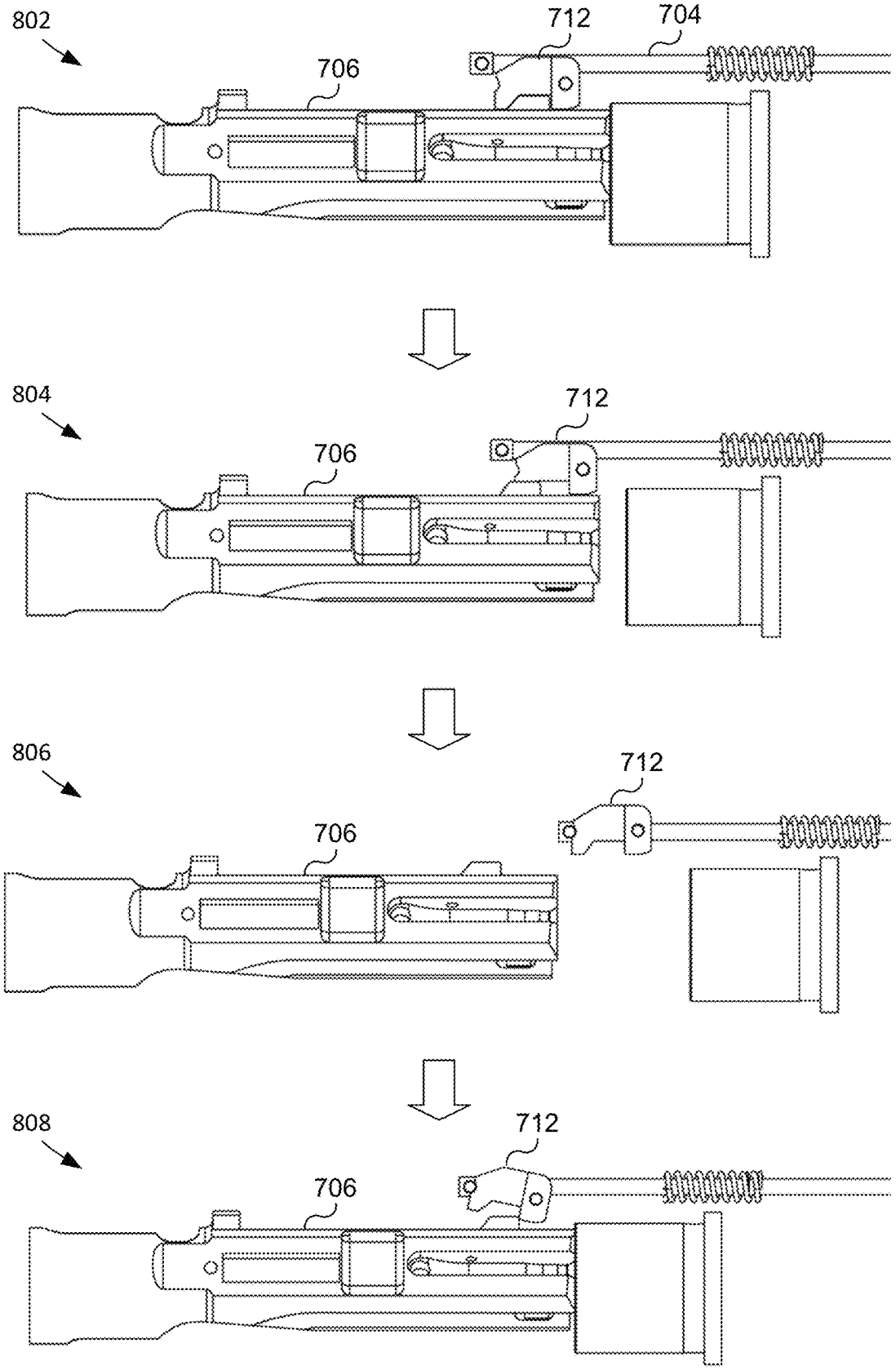
FIG. 8 is a side view diagram illustrating the rimfire delayed blowback mechanism in different positions during the cycling of the bolt carrier assembly, in accordance with examples of the subject disclosure.

FIG. 8 is a side view diagram illustrating the rimfire delayed blowback mechanism 700 in different positions during the cycling of the bolt carrier assembly 706, in accordance with examples of the subject disclosure. In the depicted example, position 802 depicts the actuator rod 704 in a forward position that maintains the locking block 712 in a locked position. This depicted locked position prevents the bolt carrier assembly 706 from moving rearward.

As described above, a small amount of exhaust gas is diverted through a gas block that pushes on the actuator rod 704, and pushes the actuator rod 704 rearward, as depicted at position 804. In this rearward position, the locking block 712 is allowed to pivot upward and allow the bolt carrier assembly 706 to move rearward and separate from the barrel. The position 804 depicts the beginning of this separation.

Position 806 depicts the bolt carrier assembly 706 in the rearward position and the locking block 712 has pivoted back to a default position and is ready to receive the bolt carrier assembly 706. Position 808 depicts the bolt carrier assembly 706 in the forward position again and the locking block 712 being pivoted downward into the locked position by the force imparted on it from the actuator rod 704 and spring 708.

Figure 9A:
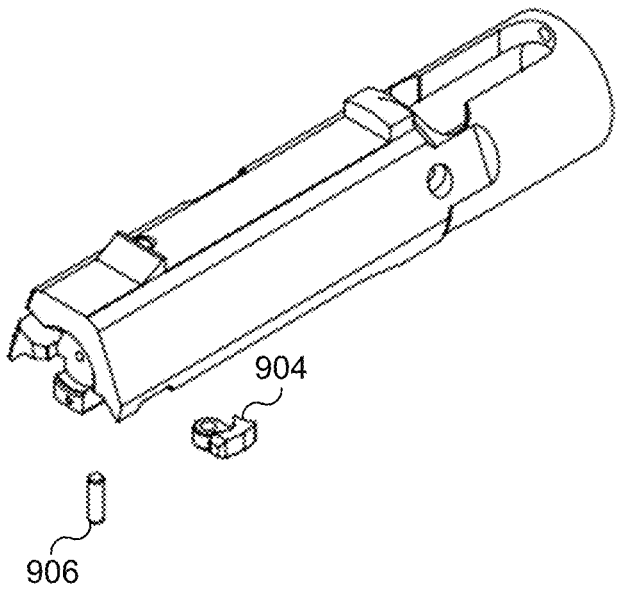
FIG. 9A is a perspective view diagram illustrating a bolt carrier assembly of an AR-style firearm having a rotatable ejector, in accordance with examples of the subject disclosure.
Figure 9B:
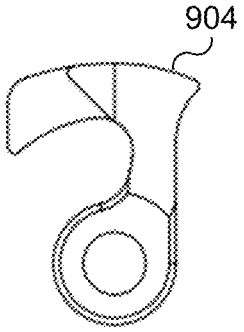
FIG. 9B is a top view diagram illustrating a rotatable ejector, in accordance with examples of the subject disclosure.

FIGS. 9A and 9B depict a bolt carrier assembly 902 of an AR-style firearm having a rotatable ejector 904, in accordance with examples of the subject disclosure. Although the bolt carrier assembly depicted is that of an AR-style firearm, it is contemplated that the features and benefits of a rotating ejector may be adapted for other styles of firearms. In certain examples, the ejector is rotatably coupled with bolt carrier assembly by a pin 906 that allows the for the ejector to rotate. A spring may be included to bias the ejector 904 to a first position. In some examples, the ejector 904 includes a hook portion with an opening selected to engage the edge of a firearm cartridge.

Figure 10:
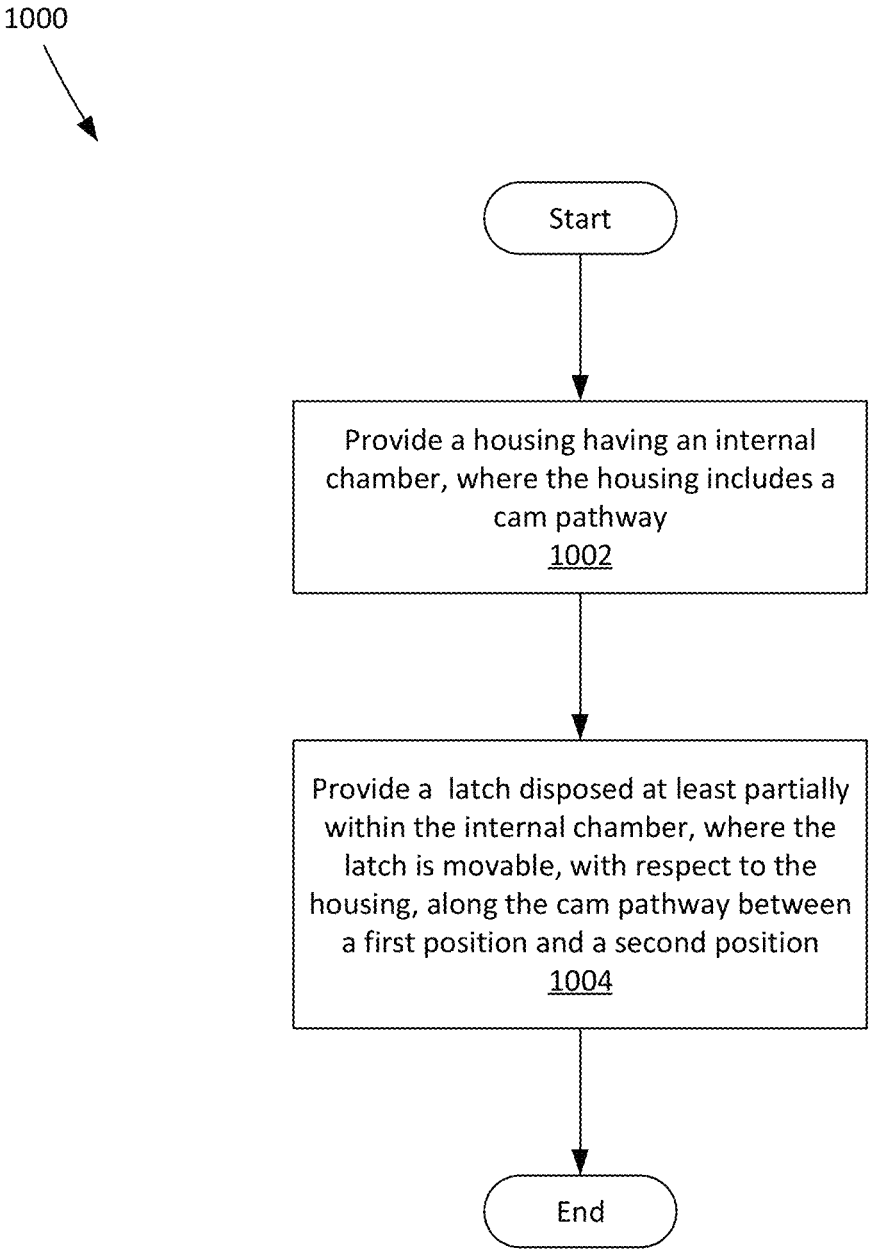
FIG. 10 is a schematic flowchart diagram illustrating one example of a method 1000 for delaying blowback of a bolt carrier assembly, in accordance with examples of the subject disclosure.

FIG. 10 is a schematic flowchart diagram illustrating one example of a method 1000 for delaying blowback of a bolt carrier assembly, in accordance with examples of the subject disclosure. In certain examples, the method 1000 includes, at block 1002, providing a housing having an internal chamber, where the housing comprises a cam pathway. The method also includes, at block 1004, providing a pivoting latch disposed at least partially within the internal chamber, where the pivoting latch is movable, with respect to the housing, along the cam pathway between a first position and a second position.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A delayed blowback device comprising:

a housing having an internal chamber, where the housing comprises a pair of ramps that define a cam pathway; and a latch disposed at least partially within the internal chamber, where the latch is slidably movable, with respect to the housing, along the cam pathway between a first position and a second position.

2. The delayed blowback device of claim 1, where the latch is configured to couple with a bolt carrier assembly of a firearm when in the first position.

3. The delayed blowback device of claim 2, where the latch further comprises a downwardly extending finger configured to engage a feature of the bolt carrier assembly.

4. The delayed blowback device of claim 2, where the latch is configured to release the bolt carrier assembly during a transition from the first position to the second position.

5. The delayed blowback device of claim 1, further comprising a pair of cutouts formed in sidewalls of the housing, and where the pair of cutouts form the cam pathway.

6. The delayed blowback device of claim 5, where the latch comprises a pass-through opening configured to receive a pin, and where the pass-though opening is configured to align with the pair of cutouts.

7. The delayed blowback device of claim 6, where the pin has a length greater than a width of the latch, and where the pin is configured to engage surfaces of the pair of cutouts.

8. The delayed blowback device of claim 7, where the pin is configured to follow the cam pathway and rotate the latch with respect to the housing as the latch moves from the first position to the second position.

9. The delayed blowback device of claim 8, further comprising a guide rod pivotally coupled to the latch and configured to pass through an opening in the housing.

10. The delayed blowback device of claim 9, further comprising a spring coupled to the guide rod and disposed adjacent to the housing, where the spring is configured to bias the latch towards the first position.

11. A firearm comprising:

a bolt carrier assembly;

a delayed blowback device configured to releasably couple to the bolt carrier assembly, where the delayed blowback device comprises:

a housing having an internal chamber, where the housing comprises a pair of ramps that define a cam pathway; and a pivoting latch disposed at least partially within the internal chamber, where the pivoting latch is slidably movable, with respect to the housing, along the cam pathway between a first position and a second position.

12. The firearm of claim 11, where the pivoting latch is configured to couple with a bolt carrier assembly of a firearm when in the first position.

13. The firearm of claim 12, where the pivoting latch further comprises a downwardly extending finger configured to engage a feature of the bolt carrier assembly.

14. The firearm of claim 13, where the pivoting latch is configured to release the bolt carrier assembly during a transition from the first position to the second position.

15. The firearm of claim 11, further comprising a pair of cutouts formed in sidewalls of the housing, and where the pair of cutouts form the cam pathway.

16. The firearm of claim 15, where the pivoting latch comprises a pass-through opening configured to receive a pin, and where the pass-though opening is configured to align with the pair of cutouts.

17. The firearm of claim 16, where the pin has a length greater than a width of the pivoting latch, and where the pin is configured to engage surfaces of the pair of cutouts.

18. The firearm of claim 17, where the pin is configured to follow the cam pathway and rotate the pivoting latch with respect to the housing as the pivoting latch moves from the first position to the second position.

19. The firearm of claim 18, further comprising:

a guide rod pivotally coupled to the pivoting latch and configured to extend through an opening in the housing; and a spring coupled to the guide rod and disposed adjacent to the housing, where the spring is configured to bias the pivoting latch towards the first position.

20. A method comprising:

providing a housing having an internal chamber, where the housing comprises a pair of ramps that define a cam pathway; and providing a pivoting latch disposed at least partially within the internal chamber, where the pivoting latch is slidably movable, with respect to the housing, along the cam pathway between a first position and a second position.

* * * * *